US008540889B1

(12) United States Patent
Hartlove et al.

(10) Patent No.: US 8,540,889 B1
(45) Date of Patent: Sep. 24, 2013

(54) METHODS OF GENERATING LIQUIDPHOBIC SURFACES

(75) Inventors: Jason Hartlove, Los Altos, CA (US); Ronald Barr, Mountain View, CA (US); Robert S. Dubrow, San Carlos, CA (US)

(73) Assignee: Nanosys, Inc., Milpitas, CA (US)

( * ) Notice: Subject to any disclaimer, the term of this patent is extended or adjusted under 35 U.S.C. 154(b) by 505 days.

(21) Appl. No.: 12/620,244

(22) Filed: Nov. 17, 2009

Related U.S. Application Data

(60) Provisional application No. 61/116,084, filed on Nov. 19, 2008.

(51) Int. Cl.
*C03C 25/68* (2006.01)

(52) U.S. Cl.
USPC ..... 216/54; 216/7; 216/11; 438/694; 977/700; 977/762; 977/832

(58) Field of Classification Search
None
See application file for complete search history.

(56) References Cited

U.S. PATENT DOCUMENTS

| | | | |
|---|---|---|---|
| 3,615,956 | A | 10/1971 | Irving et al. |
| 3,994,793 | A | 11/1976 | Harvilchuck et al. |
| 4,057,460 | A | 11/1977 | Saxena et al. |
| 4,414,066 | A | 11/1983 | Forrest et al. |
| 4,464,223 | A | 8/1984 | Gorin |
| 4,523,976 | A | 6/1985 | Bukhman |
| 4,595,454 | A | 6/1986 | Dautremont-Smith et al. |
| 4,599,136 | A | 7/1986 | Araps et al. |
| 4,639,301 | A | 1/1987 | Doherty et al. |
| 5,092,957 | A | 3/1992 | Ashby et al. |
| 5,149,974 | A | 9/1992 | Kirch et al. |
| 5,252,835 | A | 10/1993 | Lieber et al. |
| 5,820,689 | A | 10/1998 | Tseng et al. |
| 5,840,435 | A | 11/1998 | Lieber et al. |
| 5,897,945 | A | 4/1999 | Lieber et al. |
| 5,976,957 | A | 11/1999 | Westwater et al. |
| 5,997,832 | A | 12/1999 | Lieber et al. |
| 6,036,774 | A | 3/2000 | Lieber et al. |
| 6,099,960 | A | 8/2000 | Tennent et al. |
| 6,106,913 | A | 8/2000 | Scardino et al. |
| 6,130,143 | A | 10/2000 | Westwater et al. |
| 6,159,742 | A | 12/2000 | Lieber et al. |
| 6,190,634 | B1 | 2/2001 | Lieber et al. |
| 6,207,229 | B1 | 3/2001 | Bawendi et al. |
| 6,225,198 | B1 | 5/2001 | Alivisatos et al. |

(Continued)

FOREIGN PATENT DOCUMENTS

| | | |
|---|---|---|
| WO | 9918893 | 4/1999 |
| WO | 9940812 | 8/1999 |

(Continued)

OTHER PUBLICATIONS

Byeon et al., Microelectronic Engineering vol. 84, pp. 1003-1006, available on line on Feb. 1, 2007.*

(Continued)

*Primary Examiner* — Lan Vinh
*Assistant Examiner* — Jiong-Ping Lu
(74) *Attorney, Agent, or Firm* — Andrew L. Filler

(57) ABSTRACT

The present invention relates to methods of generating liquidphobic surfaces, and surfaces prepared by these methods. The methods include generating sub-micron-structured surfaces and coating these surfaces with a liquidphobic coating, such as a hydrophobic coating.

8 Claims, 9 Drawing Sheets

(56) References Cited

U.S. PATENT DOCUMENTS

| | | | | |
|---|---|---|---|---|
| 6,265,333 | B1 | 7/2001 | Dzenis et al. | |
| 6,268,041 | B1 | 7/2001 | Goldstein | |
| 6,270,347 | B1 | 8/2001 | Webster et al. | |
| 6,313,015 | B1 | 11/2001 | Lee et al. | |
| 6,322,895 | B1 | 11/2001 | Canham | |
| 6,369,288 | B1 | 4/2002 | Brown | |
| 6,666,214 | B2 | 12/2003 | Canham | |
| 6,670,179 | B1 | 12/2003 | Mattson et al. | |
| 6,720,240 | B2 | 4/2004 | Gole et al. | |
| 6,753,538 | B2 | 6/2004 | Musil et al. | |
| 6,766,817 | B2 | 7/2004 | Da Silva | |
| 6,896,864 | B2 | 5/2005 | Clarke | |
| 6,949,206 | B2 | 9/2005 | Whiteford et al. | |
| 6,969,690 | B2 | 11/2005 | Zhou et al. | |
| 7,115,526 | B2 | 10/2006 | Ho et al. | |
| 7,147,894 | B2 | 12/2006 | Zhou et al. | |
| 7,153,782 | B2 | 12/2006 | Eissa | |
| 7,267,875 | B2 | 9/2007 | Whiteford et al. | |
| 7,374,807 | B2 | 5/2008 | Parce et al. | |
| 2002/0037383 | A1 | 3/2002 | Spillman et al. | |
| 2002/0049495 | A1 | 4/2002 | Kutryk et al. | |
| 2002/0090725 | A1 | 7/2002 | Simpson et al. | |
| 2002/0130311 | A1 | 9/2002 | Lieber et al. | |
| 2002/0167118 | A1 | 11/2002 | Billiet et al. | |
| 2002/0172963 | A1 | 11/2002 | Kelley et al. | |
| 2003/0012723 | A1 | 1/2003 | Clarke | |
| 2003/0032892 | A1 | 2/2003 | Erlach et al. | |
| 2003/0059742 | A1 | 3/2003 | Webster et al. | |
| 2003/0065355 | A1 | 4/2003 | Weber | |
| 2003/0089899 | A1 | 5/2003 | Lieber et al. | |
| 2003/0093107 | A1 | 5/2003 | Parsonage et al. | |
| 2003/0102222 | A1 | 6/2003 | Zhou et al. | |
| 2003/0195611 | A1 | 10/2003 | Greenhalgh et al. | |
| 2003/0229393 | A1 | 12/2003 | Kutryk et al. | |
| 2004/0009598 | A1 | 1/2004 | Hench et al. | |
| 2004/0023317 | A1 | 2/2004 | Motamedi et al. | |
| 2004/0052867 | A1 | 3/2004 | Canham | |
| 2004/0076681 | A1 | 4/2004 | Dennis et al. | |
| 2004/0115239 | A1 | 6/2004 | Shastri et al. | |
| 2004/0116028 | A1 | 6/2004 | Bryner | |
| 2005/0008776 | A1 | 1/2005 | Chhabra et al. | |
| 2005/0038498 | A1 | 2/2005 | Dubrow et al. | |
| 2005/0096509 | A1 | 5/2005 | Olson | |
| 2005/0156504 | A1 | 7/2005 | Takai et al. | |
| 2005/0179746 | A1 | 8/2005 | Roux et al. | |
| 2005/0181195 | A1 | 8/2005 | Dubrow | |
| 2005/0219788 | A1 | 10/2005 | Chow et al. | |
| 2006/0159916 | A1 | 7/2006 | Dubrow et al. | |
| 2008/0246076 | A1* | 10/2008 | Chen | 257/316 |
| 2008/0268288 | A1* | 10/2008 | Jin | 428/800 |
| 2009/0061039 | A1* | 3/2009 | Zhang et al. | 425/436 R |

FOREIGN PATENT DOCUMENTS

| | | |
|---|---|---|
| WO | 0149776 | 7/2001 |
| WO | 0217362 | 2/2002 |
| WO | 0280280 | 10/2002 |
| WO | 03054953 | 7/2003 |
| WO | 03095190 | 11/2003 |
| WO | 03097702 | 11/2003 |
| WO | 03099951 | 12/2003 |
| WO | 03102099 | 12/2003 |
| WO | 2004094303 | 11/2004 |
| WO | 2004099068 | 11/2004 |
| WO | 2005022120 | 3/2005 |
| WO | 2007024697 | 3/2007 |

OTHER PUBLICATIONS

Suh et al., Langmuir, vol. 21, 2005, pp. 6836-6841.*
Lee et al., Nanotechnology, vol. 17, 2006, pp. 3189-3196.*
Wang et al., Journal of Crystal Growth, vol. 288, 2006, pp. 200-204.*
Martines et al., Nano Letter, vol. 5, 2005, pp. 2097-2103.*
X. Li et al., "A review on the recent progress in the preparation of superhydrophobic surfaces", Chem. Soc. Rev. vol. 36, 2007, pp. 1350-1368.*
Ashby, C.I. "Photochemical Dry Etching of GaAs", Appl. Phys. Lett. (1984) 45:892-894.
Ashby, C.I. et al., "Composition-selective Photochemical Etching of Compound Semiconductors", Appl. Phys. Lett. (1985) 47:62-63.
Autumn, K. et al., "Adhesive force of a single gecko foot-hair" Nature (2000) 405:681-685.
Chen, I.W. et al., "Sintering dense nanocrystalline ceramics without final-stage grain growth" Nature (2000) 404 (6774):168-171.
Choi, H. et al., "Surface-modified silica colloid for diagnostic imaging" J. Colloid Interface Sci (2003) 258(2):435-437.
Cui et al., "Functional nanoscale electronic devices assembled using silicon nanowire building blocks" Science (2001) 291:851-853.
Cui et al., "Nanowire nanosensors for highly sensitive and selective detection of biological and chemical species" Science (2001) 293:1289-1292.
Cui, Y. et al. "Diameter-controlled synthesis of single-crystal silicon nanowires" Appl. Phys. Lett (2001) 78 (15):2214-2216.
Cui, Y. et al."Doping and electrical transport in silicon wires" J. Phys. Chem. (2000) 104:5213-5216.
Davis, D.H. et al., "Immobilization of RGD to <111> silicon surfaces for enhanced cell adhesion and proliferation" Biomaterials (2002) 23:4019-4027.
Duan et al., "Single-nanowire electrically driven lasers" Nature (2003) 421:241-245.
Duan, X. et al. "General synthesis of compound semiconductor nanowires" Adv. Mater. (2000) 12:298-302.
Feng, L. et al. "Creation of a superhydrophobic surface from an amphiphilic polymer" Angew Chem Int. Ed. (2003) 42 (7):800-802.
Feng, L. et al. "Super-hydrophobic surface of aligned polyacrylonitrile nanofibers" Angew Chem (2002) 114 (7):1269-1271.
Feng, L. et al. "Super-hydrophobic surfaces: From Natural to Artificial" Adv. Mat. (2002) 14(24):1857-1860.
Feng, L. et al. "Superhydrophobicity of nanostructured carbon films in a wide range of pH values" Angew Chem Int Ed (2003) 42:4217-4220.
Geim, A.K. et al., "Microfabricated adhesive mimicking gecko foot-hair" Nature Materials (2003) 2:461-463.
Greene, L.E. et al., "Low-Temperature Wafer-Scale Production of ZnO Nanowire Arrays" Angew. Chem. Int. Ed. (2003) 42:3031-3034.
Gudicksen, M.S. et al. "Diameter-selective synthesis of semiconductor nanowires" J. Am. Chem. Soc. (2000) 122:8801-8802.
Gudicksen, M.S. et al. "Synthetic control of the diameter and length of single crystal semiconductor nanowires" J. Phys. Chem. (2001) 105:4062-4064.
Hanekamp C. et al., "Randomized comparison of balloon angioplasty versus silicon carbon-coated stent implantation for de novo lesions in small coronary arteries" Am. J. Cardiol. (2004) 93(10):1233-1237.
Hsieh, C-T. et al. "Influence of fluorine/carbon atomic ration on superhydrophobic behavior of carbon nanofiber arrays" J. Vac. Sci. Tech. B. (2006) 24(1):113-117.
Huang et al., "Integrated optoelectronics assembed from semiconductor nanowires" Abstracts of Papers of the ACS (2002) 224:U308.
Li, H. et al. "Super-'amphiphobic' aligned carbon nanotube films" Angew Chem Int Ed (2001) 40(9):1743-1746.
Lin, T-S. et al. "Improvement of superhydrophobic behavior of carbon nanofibers via the design of experiment and analysis of variance" J. Vac. Sci. Tech. B (2006) 24(2):855-859.
Matsui, S. et al., "Electron Beam Induced Selective Etching and Deposition Technology," Journal of Vacuum Science and Technology (1989) B7(5):1182-1190.
Morales, A.M. et al. "A laser ablation method for the synthesis of crystalling semiconductor nanowires" Science (1998) 279:208-211.
Peng, X. et al. "Shape control of CdSe nanocrystals" Nature (2000) 404:49-61.
Price, R.L. et al., "Nanometer surface roughness increases select osteoblast adhesion on carbon nanofiber compacts" J. Biomed. Mat. Res. (2004) 70A(1):129-138.
Puntes, V.F. et al. "Colloidal nanocrystal shape and size control: The case of cobalt" Science (2001) 291-2115-2117.
Shang, H.M. et al. "Nanostructured superhydrophobic surfaces" J. Mat. Sci. (2005) 40:3587-3591.

Shastri, V.P., "Non-degradable biocompatible polymers in medicine: past, present and future" Curr Pharm. Biotechnol. (2003) 4(5):331-337.
Silva, G.A. et al., "Selective differentiation of neural progenitor cells by high-epitope density nanfibers" Science (2004) 303:1352-1355.
Urban, J.J. et al. "Synthesis of single-crystalline perovskite nanowires composed of brium titanate and strontium titanate" J. Am. Chem. Soc. (2002) 124:1186-1187.
Webster, T.J. et al., "Increased osteoblast adhesion on nanophase metals: Ti, Ti6A14V, and CoCrMo" Biomaterials (2004) 25:4731-4739.
Webster, T.J. et al., "Nano-biotechnology: carbon nanofibres as improved neural and orthopaedic implants" Nanotechnology (2004) 15:48-54.
Winkler, D. et al. "E-Beam Probe Station With Integrated Tool for Electron Beam Induced Etching," Microelectronic Engineering (1996) 31:141-147.
Wu, Y. et al. "Block-by-block growth of single-crystalline Si/SiGe superlattice nanowires" Nano Lett (2002) 2:83-86.
Xu, H. et al., "Room-temperature preparation and characterization of poly(ethylene glycol)-coated silica nanoparticles for biomedical applications" J. Biomed. Mat. Res. (2003) 66A(4):870-879.
Xu, H. et al., "Strong and bioactive composites containing nano-silica-fused whiskers for bone repair" Biomaterials (2004) 25:4615-4626.
Yang, P. et al., "Inorganic semiconductor nanowires" Nanoscience (2002) 1(1):1-39.
Yun, W.S. et al. "Ferroelectric properties of individual barium titanate nanowires investigated by scanned probe microscopy" Nano Lett (2002) 2(5):447-450.
Zhou et al., "Silicon nanowires as chemical sensors" Chem. Phys. Lett. (2003) 369:220-224.

* cited by examiner 104
106
102
108
110
112
114

116

124
118

122
120

METHODS OF GENERATING LIQUIDPHOBIC SURFACES

CROSS-REFERENCE TO RELATED APPLICATION

The present application claims the benefit of U.S. Provisional Patent Application No. 61/116,084, filed Nov. 19, 2008, the disclosure of which is incorporated by reference herein in its entirety.

BACKGROUND OF THE INVENTION

1. Field of the Invention

The present invention relates to methods of generating liquidphobic surfaces, and surfaces prepared by these methods. The methods include generating sub-micron-structured surfaces and coating these surfaces with a liquidphobic coating, such as a hydrophobic coating.

2. Background of the Invention

Optically transparent or semi-transparent materials (e.g., lenses, glasses, goggles, etc.), as well as reflective or retroreflective materials, often fail to achieve optimal performance when the surface of such materials is stained or fouled by externally applied contaminants such as fluids (including biological fluids) or dirt. Fouling of such surfaces reduces the transmissive and/or reflective properties of these materials. Therefore, use of such materials in environments where fouling can occur, for example, in "dirty" environments (e.g., industrial applications, rain, high humidity) or in the body (or in contact with bodily fluids, e.g., during surgical procedures) is greatly impeded by the loss of their reflective or transmissive characteristics.

BRIEF SUMMARY OF THE INVENTION

What are needed therefore are methods for preventing or limiting fouling of optically transparent or semi-transparent materials, as well as reflective surfaces, for example by generating hydrophobic surfaces on the materials, thereby allowing them to maintain their desired properties.

The present invention fulfills the needs noted above by providing methods of generating liquidphobic (e.g., hydrophobic) surfaces. In exemplary embodiments, the methods comprise providing a first substrate having a sub-micron-structured surface. A sub-micron-structure complementary to the sub-micron-structured surface is then transferred to a surface of a second substrate. Then, a liquidphobic coating is disposed on the surface of the second substrate, to generate the liquidphobic surface.

The first substrate suitably has a plurality of sub-micron-scale indentations therein, for example, indentations having at least one lateral dimension that less than about 500 nm. In exemplary embodiments the first substrate comprises a metal, such as nickel.

Transferring of the sub-micron-structure to the second substrate suitably comprises contacting the surface of the first substrate and the surface of the second substrate, whereby the surface of the second substrate conforms to the sub-micron-structured surface of the first substrate. In exemplary embodiments, the second substrate comprises $SiO_2$. The liquidphobic coating that is disposed on the sub-micron structure suitably comprises a perfluorinated organic coating.

Additional methods of generating a liquidphobic surface comprise generating a sub-micron-structured surface on a first substrate. A sub-micron-structure complementary to the sub-micron-structured surface is transferred to a surface of a second substrate. A liquidphobic coating (e.g., a perfluorinated organic coating) is then disposed on the surface of the second substrate, to generate the liquidphobic surface.

In exemplary embodiments, the sub-micron structured surface is generated on the first substrate by a method comprising providing a substrate (e.g., a silicon substrate), and then generating a sub-micron-structured surface on the surface of the substrate to generate a transfer substrate. A sub-micron-structure complementary to the sub-micron-structured surface of the transfer substrate is then transferred to a surface of the first substrate. In exemplary embodiments, the sub-micron-structured surface that is generated on the surface of the substrate comprises depositing or growing sub-micron wires (e.g., nanowires) on the substrate. Suitably, the sub-micron-structured surface is transferred to a surface of a second substrate by evaporating and/or plating metal onto the sub-micron-structured surface of the transfer substrate, resulting in a complementary sub-micron-structure in the metal (i.e., the second substrate). Suitably nickel is evaporated and then plated onto the sub-micron-structured surface of the transfer substrate.

In further embodiments, the sub-micron structured surface is generated on the first substrate by a method comprising providing a first substrate (e.g., a metal, such as nickel). One or more masking sub-micron particles are then disposed on the first substrate, wherein the particles cover at least a portion of the substrate. Uncovered substrate material is then removed, thereby forming substrate sub-micron-scale structures at the sites of the masking particles. The masking particles are then removed.

Suitably, the generating results in a first substrate having a plurality of indentions with at least one lateral dimension less than about 500 nm. Transferring the sub-micron-structure to the second substrate suitably comprises contacting the surface of the first substrate and the surface of the second substrate, whereby the surface of the second substrate (e.g., $SiO_2$) forms to the sub-micron-structured surface of the first substrate.

The present invention also provides additional methods of generating a liquidphobic surface. Such methods comprise providing a substrate (e.g., $SiO_2$), and disposing one or more masking sub-micron particles on the substrate, wherein the particles cover at least a portion of the substrate. Uncovered substrate material is then removed, thereby forming substrate sub-micron-scale structures at the site of the masking particles. The masking particles are removed, and a liquidphobic coating (e.g., a perfluorinated organic coating) is disposed on the surface of the substrate. Suitably, a plurality of substrate structures with at least one lateral dimension less than about 500 nm are formed in the substrate.

The present invention also provides liquidphobic surfaces generated by the various methods described herein. Suitably, the liquidphobic surfaces comprise a sub-micron-structure has at least one lateral dimension less than about 500 nm, and are prepared from substrates comprising $SiO_2$. In exemplary embodiments, the liquidphobic surfaces comprise a perfluorinated organic coating, and suitably, are super-liquidphobic Additional features and advantages of the invention will be set forth in the description that follows, and in part will be apparent from the description, or may be learned by practice of the invention. The advantages of the invention will be realized and attained by the structure and particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will now be described with reference to the accompanying drawings. In the drawings, like reference numbers indicate identical or functionally similar elements.

DETAILED DESCRIPTION OF THE INVENTION

It should be appreciated that the particular implementations shown and described herein are examples of the invention and are not intended to otherwise limit the scope of the present invention in any way. Indeed, for the sake of brevity, conventional electronics, manufacturing, semiconductor devices, and nanocrystal, nanoparticle, nanowire (NW), nanorod, nanotube, and nanoribbon technologies and other functional aspects of the systems (and components of the individual operating components of the systems) may not be described in detail herein.

U.S. patent application Ser. Nos. 10/833,944, filed Apr. 27, 2004 and 11/869,508, filed Oct. 9, 2007, are incorporated by reference herein in their entireties for all purposes. These applications relate in part to various methods of forming liquidphobic surfaces.

As used herein, the term "nanostructure" refers to a structure that has at least one region or characteristic dimension with a dimension of less than about 500 nm, including on the order of less than about 1 nm. As used herein the terms "sub-micron-structure" and "sub-micron-structured" refers to a structure that has at least one region or characteristic dimension with a dimension of less than about 1 μm. As used herein, when referring to any numerical value, "about" means a value of ±10% of the stated value (e.g. "about 100 nm" encompasses a range of sizes from 90 nm to 110 nm, inclusive). The term "nanostructure" as used herein encompasses nanoparticles, quantum dots, nanocrystals, nanowires, nanorods, nanoribbons, nanofibers, nanotubes, nanotetrapods and other similar nanostructures known to those skilled in the art. As described throughout, nanostructures (including nanoparticles, nanocrystals, nanofibers, quantum dots, nanowires, etc.) suitably have at least one characteristic dimension less than about 500 nm. Suitably, nanostructures are less than about 500 nm, less than about 300 nm, less than about 200 nm, less than about 100 nm, less than about 50 nm, less than about 20 nm, less than about 15 nm, less than about 10 nm or less than about 5 nm in at least one characteristic dimension (e.g., the dimension across the width or length of the nanostructure).

Figures 1A, 1B, 1C, 1D:
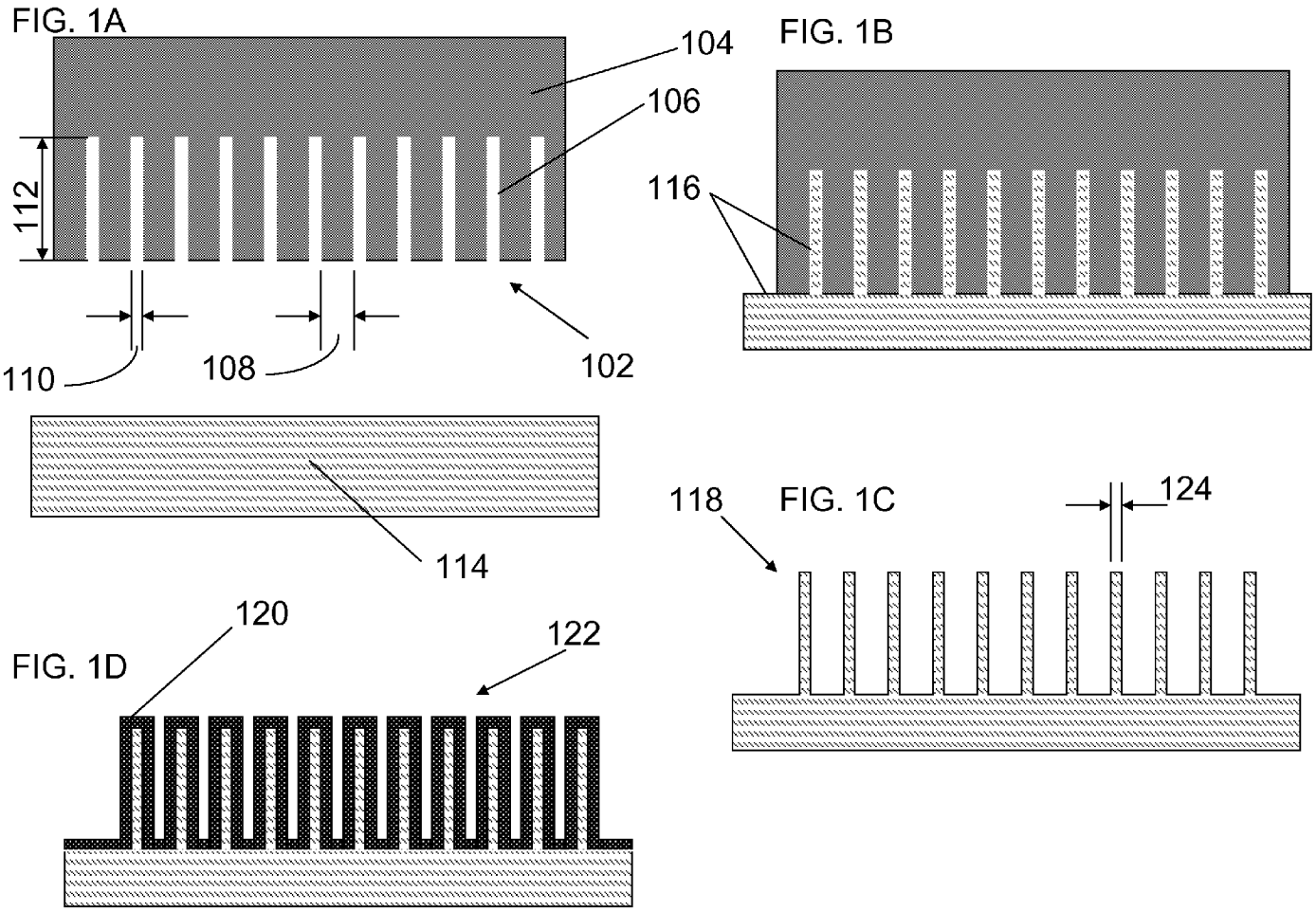
FIGS. 1A-1D show a method of generating a hydrophobic surface in accordance with one embodiment of the present invention.
Figure 1E:
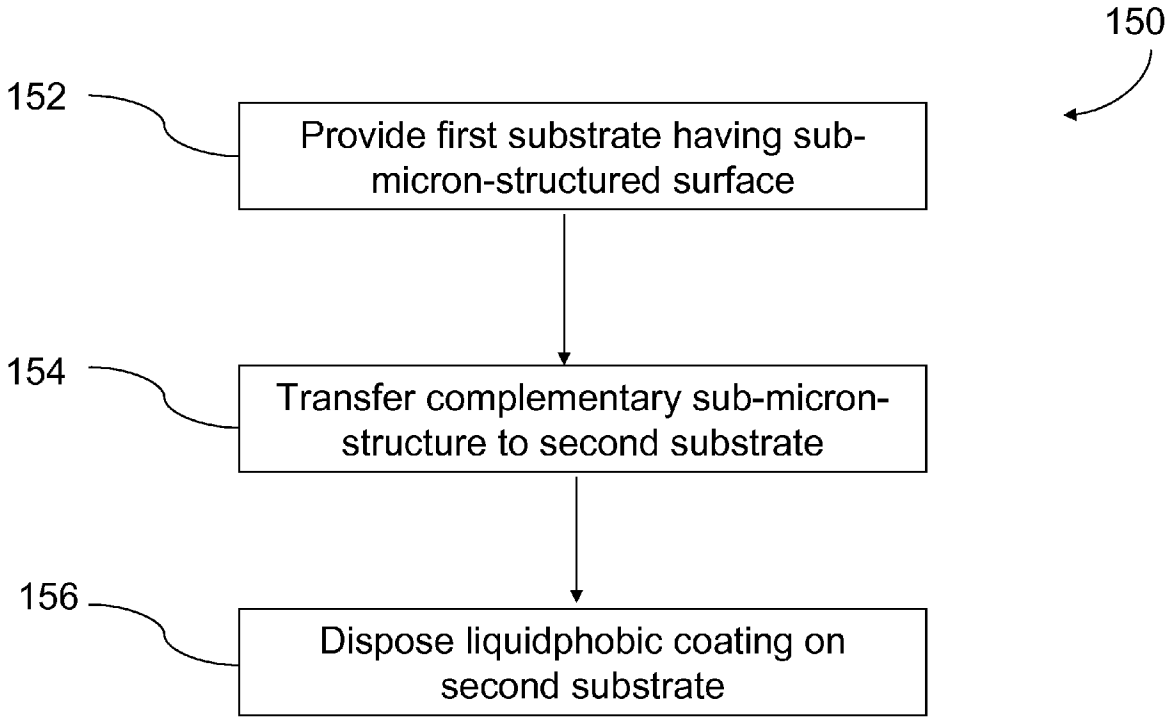
FIG. 1E shows a flowchart of a method of generating a liquidphobic surface in accordance with one embodiment of the present invention.

In one embodiment, the present invention provides methods of generating a liquidphobic surface 122, as shown in flowchart 150 of FIG. 1E, with reference to FIGS. 1A-1D. As shown in step 152 of flowchart 150, a first substrate 104 having a sub-micron-structured surface 102 is provided. In step 154 of flowchart 150, a sub-micron-structure 118 complementary to the sub-micron-structured surface 102 is transferred to a surface 116 of a second substrate 114. Then, in step 156, a liquidphobic coating 120 is disposed on the sub-micron-structured surface 116/118 of the second substrate 114.

As used herein, the term "liquidphobic surface" includes liquidphobic coatings, films, layers, 3-dimensional formations, and portions of such coatings, films, layers, and formations. That is, a liquidphobic surface need not completely cover the surface of a substrate, and in suitable embodiments, may cover only a portion of the surface. However, suitably, at least a majority, if not all, of the surface of a substrate will be covered with a liquidphobic surface. In further embodiments, a patterned surface can be generated in which portions or sections of the surface comprise a liquidphobic surface, while other portions do not (e.g., hydrophobic and non-hydrophobic sections).

As used herein, "liquidphobic" or "super-liquidphobic" surfaces and structures describe, in a general sense, any material that displays anti-liquid properties, e.g., a material that is one or more of hydrophobic (repels water), lipophobic (repels oils and lipids), amphiphobic (a material which is both hydrophobic and lipophobic), hemophobic (repels blood or blood components) or the like. Such materials repel liquids, e.g., by causing the liquid to bead-up on the material's surface and not spread out or wet the material's surface. Thus, as used herein, a substrate that is described as comprising a liquidphobic surface includes substrates that comprise a liquidphobic, super-liquidphobic, hydrophobic, super-hydrophobic, amphiphobic and/or super-amphiphobic substrate.

When a drop of a liquid (e.g., water based, lipid based, etc.) rests upon a surface, it will spread out over the surface to a degree based upon such factors as the surface tensions of the liquid and the substrate, the smoothness or roughness of the surface, etc. For example, the liquidphobicity of a substrate can be increased by various coatings that lower the surface energy of the substrate. The quantification of liquidphobicity can be expressed as the degree of contact surface angle (or contact angle) of the drop of the liquid on the surface.

For example, for a surface having a high surface energy (i.e., higher than the surface tension of the liquid drop), a drop of liquid will spread out "wetting" the surface of the substrate. Such surface displays liquidphilicity, as opposed to liquidphobicity. When the surface energy of a substrate is decreased, liquidphobicity is increased (and vice versa). Liquidphobic, including hydrophobic, lipidphobic, and/or amphiphobic, refer to properties of a substrate which cause a liquid drop on their surface to have a contact angle of 90° or greater. "Super-hydrophobicity," "super-amphiphobicity," and "super-liquidphobicity" (i.e., super-liquidphobic) all refer to properties of substances which cause a liquid drop on their surface to have a contact angle of 150° or greater.

Exemplary liquidphobic structures for use in the practice of the present invention include various chemical coatings and films, including those shown below in Table 1. The liquidphobic structure suitably generates an optically clear coating or layer on the substrate so as to not impede or impair the passage of light to and from, and/or through, the surface.

Examples of compounds that can be used to coat the substrates of the present invention beyond those listed in Table 1 are well known to those of skill in the art. Many of the exemplary liquidphobic compounds (including, e.g., hydrophobic, lipophobic, amphiphobic compounds, etc.) in Table 1 can be found in common commercial sources such as chemical catalogues from, e.g., United Chemicals, Sigma-Aldrich, etc. In exemplary embodiments, the substrates and surfaces of the present invention can be fluorinated, e.g., treated with a perfluorinated organic compound, such as a perfluorinated silane, e.g., a fluoroalkylsilane group, etc. Exemplary liquidphobic compounds include those created through treatment with silane agents, heptadecafluorodecyltrichlorosilane, perfluorooctyltriclorosilane, heptadecafluorodecyltrimethoxysilane, perfluorododecyltrichlorosilane, perfluorinated carbon chains (e.g., perfluorooctyl trichlorosilane), polyvinyliden fluoride, polyperfluoroalkyl acrylate, octadecanethiol, fluorine compounds (e.g., graphite fluoride, fluorinated monoalkyl phosphates, $C_4F_8$, etc.), etc. In other embodiments, the liquidphobic structures can comprise coatings of fluorocarbons, Teflon®, silicon polymers (e.g., Hydrolam 100®), polypropylene, polyethylene, wax (e.g., alkylketene dimers, paraffin, fluorocarbon wax, etc.), plastic (e.g., isotactic polypropylene, etc.), PTFE (polytetrafluoroethylene), diamond and diamond-like surfaces, as well as inorganic materials. Additional exemplary liquidphobic structures/coatings are listed below in Table 1.

TABLE 1

| Liquidphobicity | Functionality | Chemical Name |
|---|---|---|
| Hydrophobic | C2 | Ethyltrichlorosilane |
| Hydrophobic | C2 | Ethyltriethoxysilane |
| Hydrophobic | C3 | n-Propyltrichlorosilane |
| Hydrophobic | C3 | n-Propyltrimethoxysilane |
| Hydrophobic | C4 | n-Butyltrichlorosilane |
| Hydrophobic | C4 | n-Butyltrimethoxysilane |
| Hydrophobic | C6 | n-Hexyltrichlorosilane |
| Hydrophobic | C6 | n-Hexyltrimethoxysilane |
| Hydrophobic | C8 | n-Octyltrichlorosilane |
| Hydrophobic | C8 | n-Octyltriethoxysilane |
| Hydrophobic | C10 | n-Decyltrichlorosilane |
| Hydrophobic | C12 | n-Dodecyltrichlorosilane |
| Hydrophobic | C12 | n-Dodecyltriethoxysilane |
| Hydrophobic | C18 | n-Octadecyltrichlorosilane |
| Hydrophobic | C18 | n-Octadecyltriethoxysilane |
| Hydrophobic | C18 | n-Octadecyltrimethoxysilane |
| Hydrophobic | C18 | Glassclad-18 |
| Hydrophobic | C20 | n-Eicosyltrichlorosilane |
| Hydrophobic | C22 | n-Docosyltrichlorosilane |
| Hydrophobic | Phenyl | Phenyltrichlorosilane |
| Hydrophobic | Phenyl | Phenyltriethoxysilane |
| Amphiphobic | Tridecafluorooctyl | (Tridecafluoro-1,1,2,2,-tetrahydrooctyl)-1-trichlorosilane |
| Amphiphobic | Tridecafluorooctyl | (Tridecafluoro-1,1,2,2,-tetrahydrooctyl)-1-triethoxysilane |
| Amphiphobic | | Fluorinated alkanes |
| | | Fluoride containing compounds |
| | | Alkoxysilane |
| | | PTFE |
| | | hexamethyldisilazane |
| | | Aliphatic hydrocarbon containing compounds |
| | | Aromatic hydrocarbon containing compounds |
| | | Halogen containing compounds |
| | | Paralyene and paralyene derivatives |
| | | Fluorosilane containing compounds |
| | | Fluoroethane containing compounds |

In exemplary embodiments, the first substrate 104 provided in step 152 of flowchart 150, has a plurality of sub-micron-scale indentations 106 in the surface. As shown in FIG. 1A, suitably these indentations 106 are present throughout the surface of the substrate 104, though in other embodiments they can only be present in a portion of the substrate. Indentations 106 suitably have at least one lateral dimension 110 (a dimension in the plane of the surface substrate 104) that is less than about 1 μm (e.g., a sub-micron structure/dimension). For example, indentation 106 can have a lateral dimension 110 of less than about 900 nm, less than about 750 nm, less than about 500 nm, less than about 250 nm, less than about 100 nm, less than about 50 nm, or less than about 10 nm. Indentation 106 will also have at least one additional lateral dimension (not shown in FIG. 1A) that is also suitably sub-micron in dimension (e.g., less than about 1 μm, less than about 900 nm, less than about 750 nm, less than about 500 nm, less than about 250 nm, less than about 100 nm, less than about 50 nm, or less than about 10 nm).

As shown in FIG. 1A, indentation 106 suitably has a dimension 112 that extends into the plane of the surface of substrate 104. Suitably, dimension 112 extends normal into the plane of the surface of substrate 104 (e.g., about 90° relative to the plane of the surface of substrate 104), though can extend into the plane of the surface of substrate 104 at any angle (e.g., about 10° to about 90°). Dimension 112 of indentations 116 is generally on the order of about a few nanometers, to 10s of nanometers, to 100s of nanometers, to microns (not shown to scale in FIG. 1A). As shown in FIG. 1A, sub-micron-scale indentations 106 are separated by a distance 108 of less than about 1 μm, less than about 900 nm, less than about 750 nm, less than about 500 nm, less than about 250 nm, less than about 100 nm, less than about 50 nm, or less than about 10 nm. It should be noted that the sub-micron-scale indentations can be uniform, though in other embodiments they can be randomly spaced and sized. In addition, the dimension 112 indentions 116 can be longer, shorter, or of the same size as the later dimension 110.

In exemplary embodiments, first substrate 104 comprises a metal. Exemplary metals that can be used as substrate 104 include, but are not limited to, Pd, Pt, Ni, W, Ru, Ta, Co, Mo, Ir, Re, Rh, Hf, Nb, Au, Ag, Fe, Al, $WN_2$ and TaN. Suitably the substrate is a nickel substrate.

As shown in FIG. 1B, transferring a sub-micron-structure complementary to the sub-micron-structured surface 102 to the surface 116 of substrate 114 comprises contacting the surface 102 of the first substrate 104 and the surface 116 of the second substrate 114, whereby the surface of the second substrate 116 conforms to the sub-micron structured surface of the first substrate 102.

As used herein a "sub-micron-structure complementary to" and a "complementary sub-micron-structure" refer to structures that, upon generation, fill in, match, and correspond to the sub-micron structured surface that was utilized to transfer the sub-micron structure. For example, as shown in FIGS. 1A-1C, when a sub-micron structured surface 102 is contacted with a surface 116 of second substrate 114, suitably the surface of the substrate conforms, i.e., flows, spreads, wicks or otherwise fills (or at least partially fills) indentations 106 (i.e., FIG. 1B), so as to form a sub-micron structure surface 118 that is complementary to the surface 102 from which it was produced (see FIG. 1C).

In exemplary embodiments, sub-micron-structured surface 102 is contacted with substrate 114, which is in a state that allows it to conform to the surface 102 (e.g., a liquid, semi-solid, partial liquid or other similar state). For example, the substrate 114 can be a material, which at room temperature (about 20-28° C.) conforms to the surface 102, or the substrate 114, the surface 102, or both the substrate and the surface can be heated so as to change the state of the substrate 114 such that it will be able to conform to the sub-micron-structured surface, thereby generating a complementary sub-micron-structured surface 118.

Exemplary substrates 114, which can be utilized in the practice of the present invention, include various metals, polymers, plastics, glasses, ceramics, etc. Suitably, the substrate is a transparent or semi-transparent glass or polymeric material, such as $SiO_2$, or other glass. As used herein, transparent materials are those that allow passage of at least 70% of light which impacts the material is able to pass through the material unimpeded, while semi-transparent materials include those that allow passage of at least 50% of the impacting light.

As noted above, any liquidphobic coating 120 can be disposed on the sub-micron-structured surface 118, including those disclosed herein, such as those listed in Table 1. In exemplary embodiments, liquidphobic coating 120 comprises a perfluorinated organic coating. In exemplary embodiments, liquidphobic coating 120, is directly disposed on the surface of sub-micron-structured surface 118. Methods for disposing such structures and coatings include, but are not limited to, painting, spraying, layering, dipping, spin-coating, applying, evaporative deposition, etc.

The present invention also provides liquidphobic surfaces 122 generated by the processes of the present invention. As the sub-micron-structured surface that is generated 118 by the transfer of the complementary structure from surface 102 to the substrate 114, the sub-micron-structure that is generated 118 suitably has at least one lateral dimension (i.e., 124) less than about 1 μm, suitably less than about 750 nm, less than about 500 nm, less than about 250 nm, or less than about 100 nm. Sub-micron-structured surface suitably will comprise uniform or fairly uniform structures thereon, though in other embodiments, the dimensions and spacings of the structures that make up the sub-micron-structured surface can be variable, including different heights, different lateral dimensions, different spacings and different configurations/shapes.

Generating liquidphobic surfaces 122 by combining an underlying or supporting sub-micron-structured surface 118, which is then coated with a liquidphobic coating 120, allows the production of super-liquidphobic surfaces.

The ability to generate liquidphobic and super-liquidphobic surfaces allows for the preparation of surfaces where fouling or contamination are highly undesirable. These surfaces include transparent or semi-transparent surfaces, such as lenses, glasses, goggles, windshields, windows, display screens, etc. Additional surfaces which benefit from the generation of a liquidphobic or super-liquidphobic surface include reflective surfaces.

As used herein the term "reflective substrate" or "reflective surface" refers to a material that has at least one surface that reflects light. Reflective substrates also include "retroreflective substrates" which send light or other radiation back in the same direction it initiated from, regardless of the angle of incidence. Light that can be reflected by the various reflective substrates include visible light, as well as non-visible light including, but not limited to, infrared and ultraviolet wavelengths. Exemplary reflective substrates that can be utilized in the practice of the present invention include various films, paints, reflective marker dots, tapes, fabrics and coatings, as well as various structures, such as reflective objects, including reflective spheres, cubes (or any other shape). Reflective substrates also include materials that have a reflective coating or layer on their surface. The terms "reflective substrate" and "reflective material" are used interchangeably throughout.

As discussed throughout, contact between a liquid and a material can result in fouling or otherwise contamination of the surface of a material. Fouling can occur when a material is contacted with a liquid, often containing various unwanted contaminants, such as dirt, debris, oils, salts, lipids, or biological fluids such as blood, urine, saliva, marrow, fat, etc., which contain various elements which can stick to and thus contaminate the surface of a material. Through the addition of a liquidphobic structure, for example a hydrophobic coating to the surface of a material, liquids are repelled from the surface, and thus liquids, including contaminants in the liquids, cannot reach and/or attach to the surface.

Suitably, the application of a liquidphobic structure to a transparent or reflective substrate allows the substrate to maintain its transmissive or reflective properties, respectively, after contact with a liquid. In addition, it is important that the liquidphobic structure does not significantly impair the reflective or transmissive characteristics of the substrate. As used herein, the term "reflective properties" refers to the ability of a surface to send back some or all of the light that strike the surface. This includes sending back all of the wavelengths of light that strikes a surface, as well as sending back at least some of the wavelengths of light that strike a surface. Thus, reflective properties refers to both the efficiency of sending back light (i.e., the intensity that reflects back) as well as the completeness of the spectrum that is reflected, i.e., the percentage of wavelengths that are sent back. Suitably, the light is sent back to a receiver or detector. In exemplary embodiments, at least about 100% of the light that strikes a surface is sent back, or at least about 95%, at least about 90%, at least about 85%, at least about 80%, at least about 75%, at least about 70%, at least about 65%, at least about 60%, at least about 55%, at least about 50%, at least about 45%, at least about 40%, etc., of the light is sent back.

As used herein, the term "transmissive properties" refers to the ability of a surface to allow some or all of the light that strikes the surface to pass through the surface unimpeded. This includes allowing all of the wavelengths of light that strikes a surface to pass, as well as allowing at least some of the wavelengths of light that strike a surface to pass. Thus, transmissive properties refers to both the efficiency of allowing light to pass (i.e., the intensity) as well as the completeness of the spectrum that is allowed to pass, i.e., the percentage of wavelengths that pass through the material. As noted above, the transmissive properties of transparent materials are those which allow passage of at least 70% of light which impacts the material is able to pass through the material unimpeded, while the transmissive properties semi-transparent materials include those that allow passage of at least 50% of the light.

In suitable embodiments, the substrates comprising a liquidphobic surface of the present invention maintain at least about 50% of their reflective properties after contact with a liquid. More suitably, a substrate maintains at least about 55%, at least about 60%, at least about 65%, at least about 70%, at least about 75%, at least about 80%, at least about 85%, at least about 90%, at least about 95%, at least about 99%, or about 100% of its reflective properties. As used herein, the term "substantially maintain" as used to refer to the reflective characteristics of a substrate is used to indicate that the substrate maintains at least about 50% of its reflective properties after contact with a liquid.

In additional embodiments, the substrates comprising a liquidphobic surface of the present invention maintain at least about 50% of their transmissive properties after contact with a liquid. More suitably, a substrate maintains at least about 55%, at least about 60%, at least about 65%, at least about 70%, at least about 75%, at least about 80%, at least about 85%, at least about 90%, at least about 95%, at least about 99%, or about 100% of its transmissive properties. As used herein, the term "substantially maintain" as used to refer to the transmissive characteristics of a substrate is used to indicate that the substrate maintains at least about 50% of its transmissive properties after contact with a liquid.

Disposition of liquidphobic structures onto the surface 118 of substrate 114 can be facilitated by the use of appropriate chemical groups so as to aid spreading and/or bonding of the liquidphobic structures to the substrate. For example, in applications where a perfluorinated organic layer is disposed on the substrate, chemically reactive groups that couple to the layer are often desired on the substrate, such as silanols on the surface of a substrate onto which a layer of perfluorinated silane is to be disposed, so as to facilitate silane coupling. In additional embodiments, an adhesive layer can be applied to the surface of the reflective material so as to facilitate interaction between the liquidphobic structures and the reflective material.

As discussed throughout, in suitable embodiments, various liquidphobic structures, including perfluorinated organic coatings, such as perfluorinated silane coatings, can be disposed on the sub-micron-structured surfaces and nano-structured surfaces of substrates. In general, the more structured a surface, or the higher the surface area of a substrate, the less likely the surface will be prone to fouling after disposition of a liquidphobic structure (e.g., a hydrophobic coating).

In additional embodiments, the present invention provides further methods of generating a liquidphobic surface 122. Suitably, as shown in flowchart 160 of FIG. 1F, with reference to FIGS. 1A-1D, the methods comprise step 162 of generating a sub-micron-structured surface 102 on a first substrate 104. A sub-micron-structure 118 complementary to the sub-micron-structured surface 102 is transferred in step 164 to a surface 116 of a second substrate 114. Then in step 166, a liquidphobic coating 120 is disposed on the surface of the second substrate 118.

As described herein, suitably the transferring in step 164 comprises contacting the surface 102 of the first substrate 104 and the surface 116 of the second substrate 114, whereby the surface 116 of the second substrate forms to the sub-micron-structured surface of the first substrate. In exemplary embodiments, the first substrate 104 is contacted with a second substrate comprising $SiO_2$. As described herein, the disposing of a liquidphobic coating 120 in step 166, suitably comprises disposing a perfluorinated organic coating on the sub-micron-structured 118 surface of the second substrate.

Figure 1F:
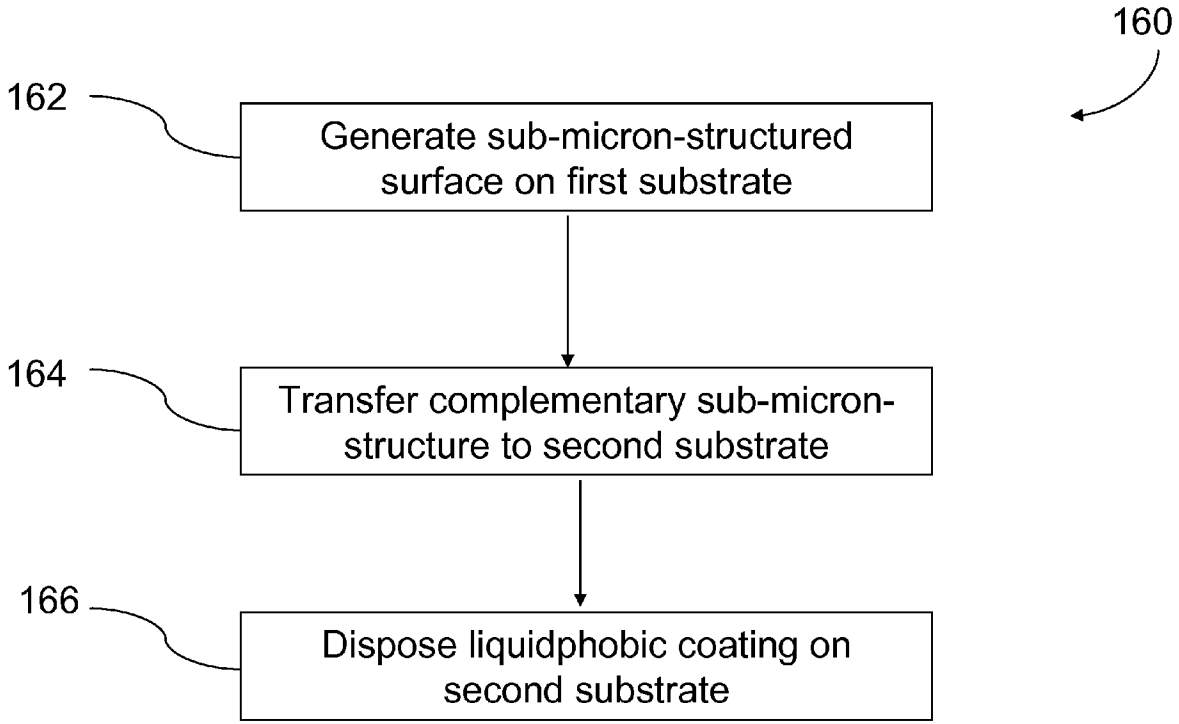
FIG. 1F shows a flowchart of an additional method of generating a liquidphobic surface in accordance with one embodiment of the present invention.
Figure 2B:
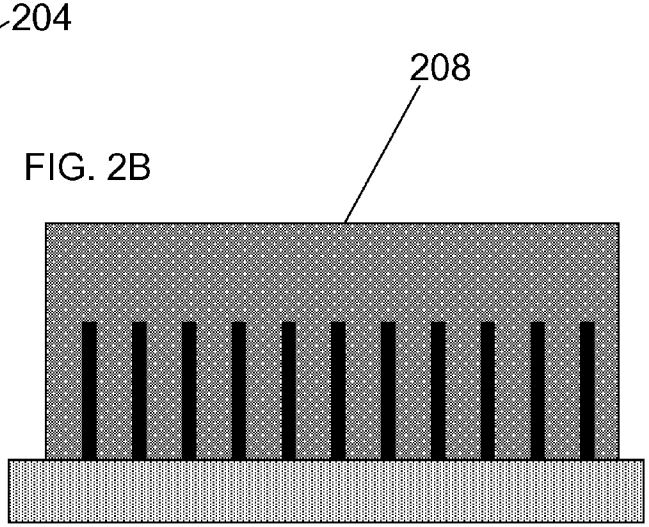
FIGS. 2A-2C show a method of generating a sub-micron structured surface in accordance with one embodiment of the present invention.
Figure 2A:
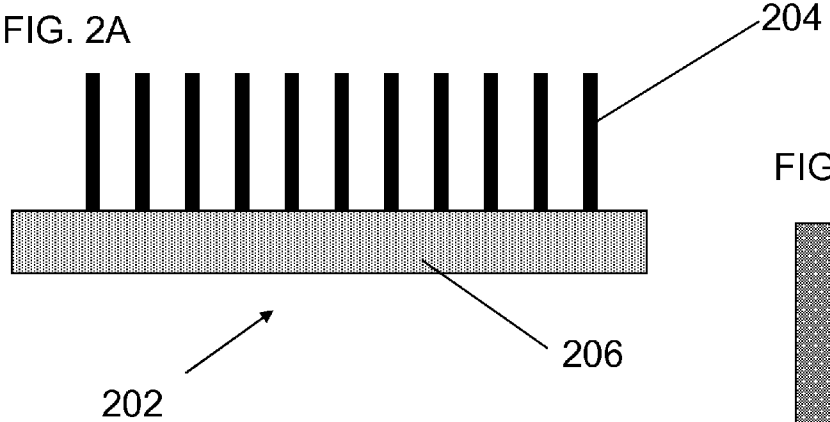
Figure 2C:
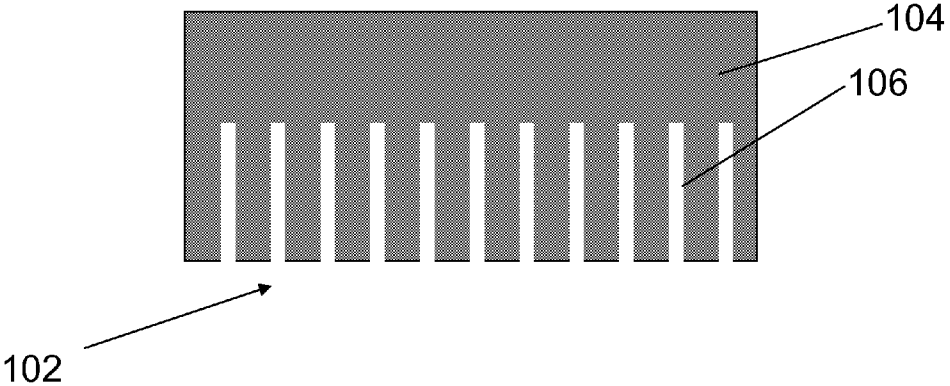
Figure 2D:
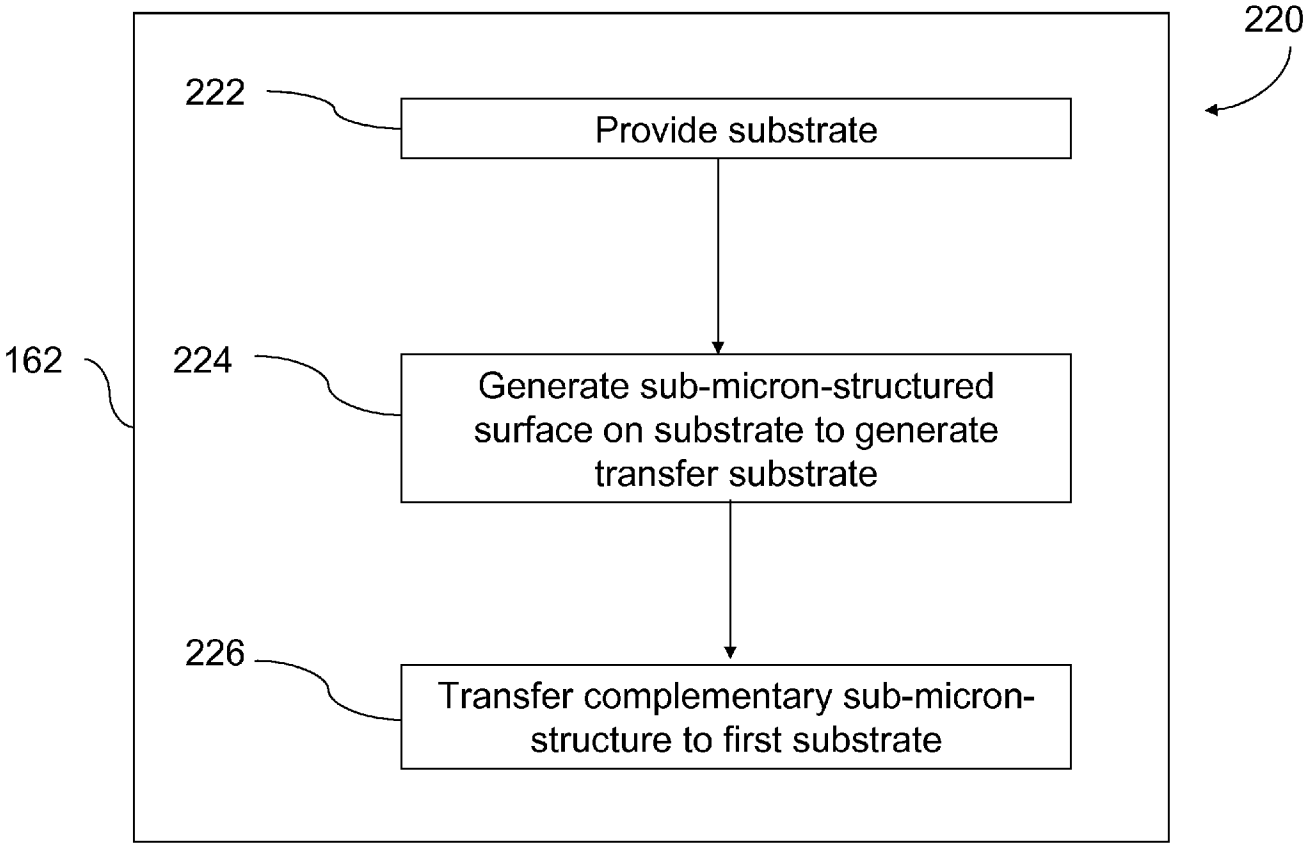
FIG. 2D shows a flowchart of a method of generating a sub-micron structured surface in accordance with one embodiment of the present invention.

In suitable embodiments, the generating of sub-micron structured surface 102 on first substrate 104 in step 162 of flowchart 160 in FIG. 1F, comprises a method as shown in flowchart 220 of FIG. 2D, with reference to FIGS. 2A-2C. In exemplary embodiments, in step 222, a substrate 206 is provided. In step 224 of flowchart 220, a sub-micron structured surface 204 is generated on the substrate to generate a transfer substrate 202. In step 226 of flowchart 220, a sub-micron-structure 102 complementary to the sub-micron structured surface 204 of the transfer substrate 202 is transferred to a surface of the first substrate 104.

In exemplary embodiments of such methods, a silicon substrate 206 is provided, though any suitable substrate can be provided, including various semiconductors, polymers, glasses, ceramics, metals, etc. Suitably, the sub-micron structured surface 204 that is generated on substrate 206 comprises sub-micron wires, sub-micron crystals, sub-micron particles or other sub-micron structures. Suitably, the sub-micron structure 204 is deposited on the substrate. For example a plurality (i.e., 2 or more, suitably 5, 10, 50, 100, etc.) of sub-micron structures, such as sub-micron wires or other sub-micron particles are deposited on the substrate 206. In exemplary embodiments, sub-micron wires, for example, nanowires, are deposited on the substrate 206. In other embodiments, the sub-micron wires or nanowires can be grown on the transfer substrate 206. As noted herein, sub-micron structures include wires, crystals, particles, rods, tubes, and other similar structures. Nanostructures include nanowires, nanorods, nanoparticles, nanocrystals, nanofibers, etc.

Sub-micron wires are characterized by at least one cross-sectional dimension that less than about 1000 nm, and include nanowires, which in general have at least one cross-sectional dimension that is less than about 500 nm, less than about 250 nm, less than about 100 nm, less than about 50 nm, less than about 40 nm, less than about 30 nm, less than about 20 nm, less than about 10 nm, or even about 5 nm or less. In many cases the region or characteristic dimension will be along the smallest axis of the structure. Sub-micron wires and nanowires of the invention typically have one principle axis that is longer than the other two principle axes and, thus, have an aspect ratio greater than one, an aspect ratio of 2 or greater, an aspect ratio greater than about 10, an aspect ratio greater than about 20, and often an aspect ratio greater than about 100, 200, 500, 1000, or 2000.

Sub-micron wires and nanowires for use in the practice of the present invention suitably comprise any of a number of different materials and can be fabricated from essentially any convenient material or materials. In some typical embodiments herein, the sub-micron wires and nanowires of the invention comprise a non-carbon or inorganic material. Also, in some embodiments, the sub-micron wires and nanowires comprise silicon or a silicon containing compound (e.g., a silicon oxide). In certain embodiments, the sub-micron wires and nanowires range in length from about 10 nm to about 200 um, or from about 20 nm to about 100 um, or from about 20 nm or 50 nm to about 500 nm.

The term nanostructure can optionally also include such structures as, e.g., nanowires, nanowhiskers, semi-conducting nanofibers and non-carbon nanotubes (e.g., boron nanotubes or nanotubules) and the like. Additionally, in some embodiments herein, nanocrystals or other similar nanostructures can also be used. For example, nanostructures having smaller aspect ratios (e.g., than those described above), such as nanorods, nanotetrapods, nanoposts (e.g., non-silicon nanoposts), and the like are also optionally included within the nanostructure definition herein (in certain embodiments). Examples of such other optionally included nanostructures can be found, e.g., in published PCT Application No. WO 03/054953 and the references discussed therein, all of which are incorporated herein by reference in their entirety for all purposes.

Suitably, sub-micron wires and nanowires for use in the practice of the present invention will comprise semiconductor materials or semiconductor elements such as those disclosed in U.S. patent application Ser. No. 10/796,832, and include any type of semiconductor, including group II-VI, group III-V, group IV-VI and group IV semiconductors. Suitable semiconductor materials include, but are not limited to, Si, Ge, Sn, Se, Te, B, C (including diamond), P, BN, BP, BAs, AlN, AlP, AlAs, AlSb, GaN, GaP, GaAs, GaSb, InN, InP, InAs, InSb, AlN, AlP, AlAs, AlSb, GaN, GaP, GaAs, GaSb, ZnO, ZnS, ZnSe, ZnTe, CdS, CdSe, CdTe, HgS, HgSe, HgTe, BeS, BeSe, BeTe, MgS, MgSe, GeS, GeSe, GeTe, SnS, SnSe, SnTe, PbO, PbS, PbSe, PbTe, CuF, CuCl, CuBr, CuI, $Ge_3N_4$, $(Al, Ga, In)_2 (S, Se, Te)_3$, $Al_2CO$, and an appropriate combination of two or more such semiconductors. In further embodiments, the sub-micron wires and nanowires can comprise materials such as metals, polysilicons, polymers, insulator materials, etc. Suitable metals include, but are not limited to, Pd, Pt, Ni, W, Ru, Ta, Co, Mo, Ir, Re, Rh, Hf, Nb, Au, Ag, Fe, Al, $WN_2$ and TaN. Suitable insulator materials include, but are not limited to, $SiO_2$, $TiO_2$ and $Si_3N_4$.

Common methods for making sub-micron wires and nanowires include vapor liquid solid growth (VLS), laser ablation (laser catalytic growth) and thermal evaporation. See, for example, Morales et al. (1998) "A Laser Ablation Method for the Synthesis of Crystalline Semiconductor Nanowires" *Science* 279, 208-211 (1998). In one exemplary approach, a hybrid pulsed laser ablation/chemical vapor deposition (PLA-CVD) process for the synthesis of semiconductor nanofibers with longitudinally ordered heterostructures is used. See, Wu et al. (2002) "Block-by-Block Growth of Single-Crystalline Si/SiGe Superlattice Nanowires," *Nano Letters* 2:83-86.

Growth of nanostructures, such as nanowires, having various aspect ratios, including nanowires with controlled diameters, is described in, e.g., Gudiksen et al. (2000) "Diameter-selective synthesis of semiconductor nanowires" *J. Am. Chem. Soc.* 122:8801-8802; Cui et al. (2001) "Diameter-controlled synthesis of single-crystal silicon nanowires" *Appl. Phys. Lett.* 78: 2214-2216; Gudiksen et al. (2001) "Synthetic control of the diameter and length of single crystal semiconductor nanowires" *J. Phys. Chem. B* 105:4062-4064; Morales et al. (1998) "A laser ablation method for the synthesis of crystalline semiconductor nanowires" *Science* 279: 208-211; Duan et al. (2000) "General synthesis of compound semiconductor nanowires" *Adv. Mater.* 12:298-302; Cui et al. (2000) "Doping and electrical transport in silicon nanowires" *J. Phys. Chem. B* 104:5213-5216; Peng et al. (2000), supra; Puntes et al. (2001), supra; U.S. Pat. No. 6,225,198 to Alivisatos et al., supra; U.S. Pat. No. 6,036,774 to Lieber et al. (Mar. 14, 2000) entitled "Method of producing metal oxide nanorods"; U.S. Pat. No. 5,897,945 to Lieber et al. (Apr. 27, 1999) entitled "Metal oxide nanorods"; U.S. Pat. No. 5,997,832 to Lieber et al. (Dec. 7, 1999) "Preparation of carbide nanorods"; Urbau et al. (2002) "Synthesis of single-crystalline perovskite nanowires composed of barium titanate and strontium titanate" *J. Am. Chem. Soc.,* 124, 1186; Yun et al. (2002) "Ferroelectric Properties of Individual Barium Titanate Nanowires Investigated by Scanned Probe Microscopy" *Nano Letters* 2, 447; and published PCT application Nos. WO 02/17362, and WO 02/080280.

In suitable embodiments, as shown in FIG. 2B, transferring step 226, comprises disposing a material 208 onto sub-micron-structured surface 204 (e.g., sub-micron wires or nanowires). This results in a complementary sub-micron-structure 102 in the final material 104, represented as indentations 106 in FIG. 2C. Suitably, the disposing comprises evaporating and/or plating to deposit the material 208 onto the sub-micron-structured surface 204. The material that is disposed, e.g., evaporated or plated, can include a polymer, a metal, or any other suitable material. In exemplary embodiments, nickel is evaporated and/or plated onto the sub-micron-structured surface 204. Methods of evaporating and/or plating nickel are well known in the art. Suitably, the nickel is first evaporated onto the sub-micron-structured surface 204, and then a final layer or layers are plated onto the surface to form the substrate 104, which comprises indentations 106 and sub-micron structured surface 102. Additional methods for disposing material 208 onto sub-micron-structured surface 204 are well known in the art, and include, for example, sputtering, dip-coating, spin-coating, spray-coating, layering, painting, etc.

Figures 3A, 3B, 3C:
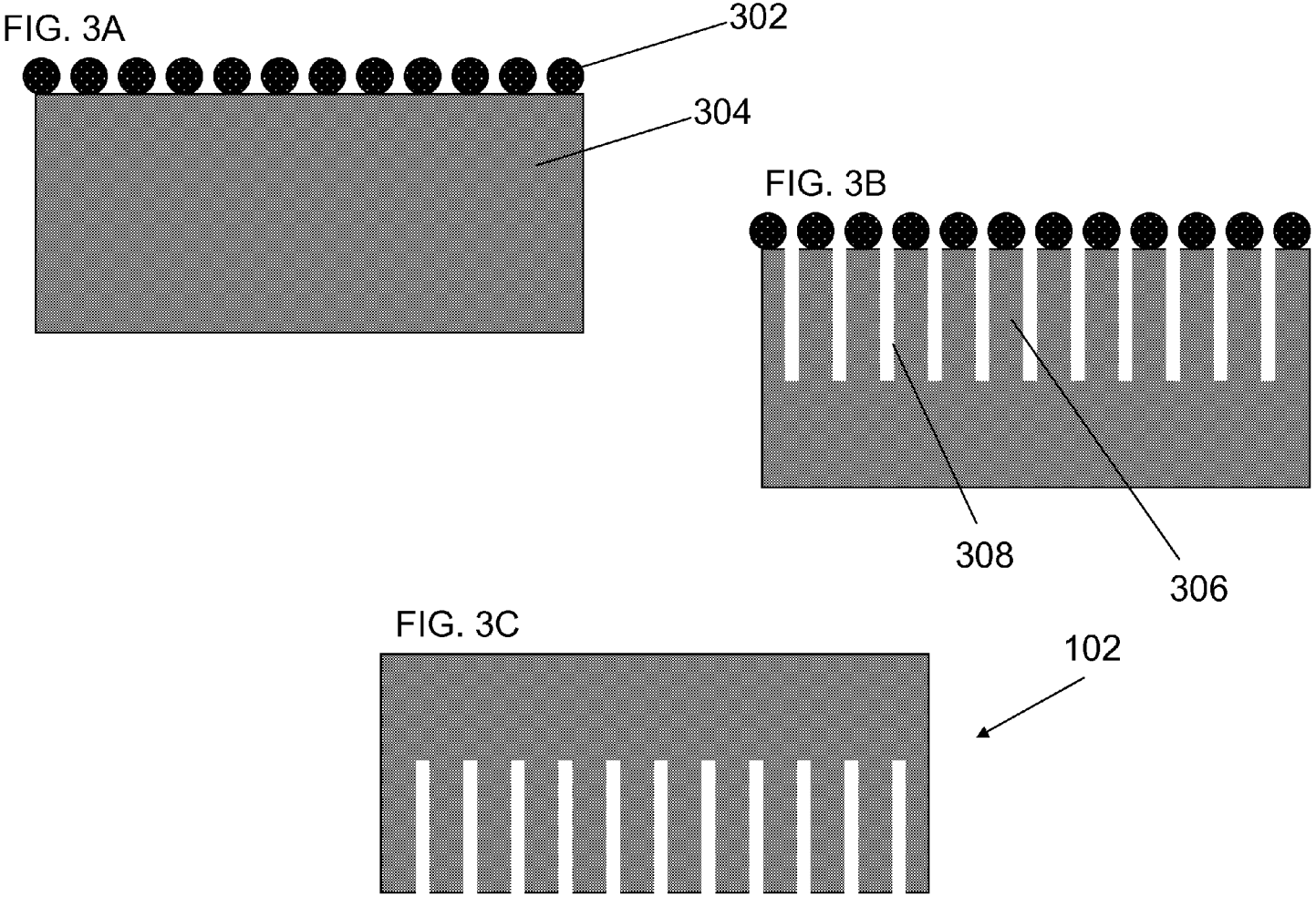
FIGS. 3A-3C show an additional method of generating a sub-micron structured surface in accordance with one embodiment of the present invention.
Figure 3D:
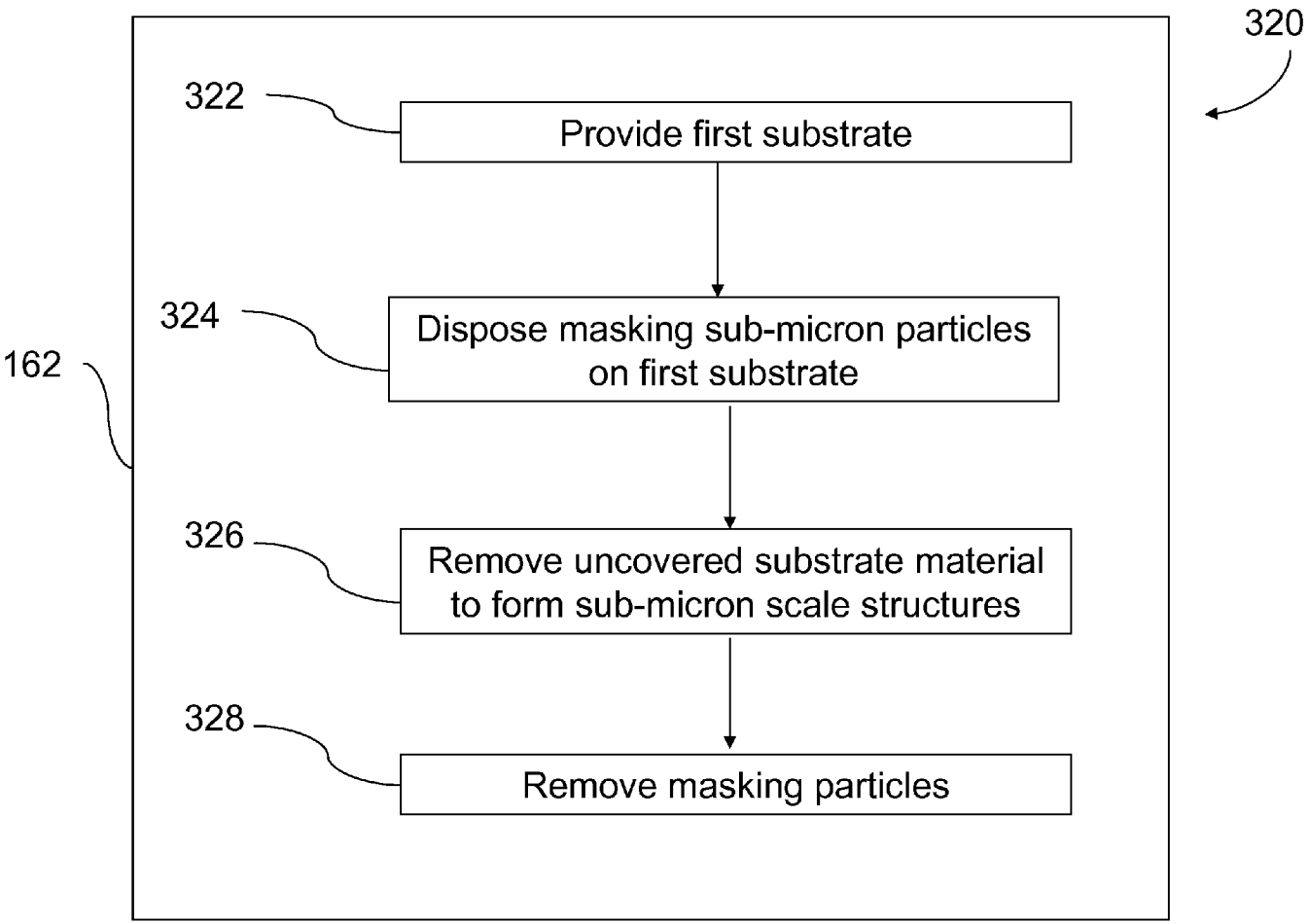
FIG. 3D shows a flowchart of an additional method of generating a sub-micron structured surface in accordance with one embodiment of the present invention.

In further embodiments, as shown in FIG. 3D, with reference to FIGS. 3A-3C, generation of a sub-micron-structured surface 102 on the first substrate 104 in step 162 of flowchart 160 of FIG. 1F, can comprise the method set forth in flowchart 320 of FIG. 3D. In step 322 of flowchart 320, a first substrate 304 is provided. Then, in step 324 of flowchart 320, one or more masking sub-micron particles 302 are disposed on at least a portion of the first substrate 304, as shown in FIG. 3A. In step 326 of flowchart 320, uncovered substrate material is then removed, thereby forming substrate sub-micron scale structures 306 at the sites of the masking particles, as shown in FIG. 3B. In step 328 of flowchart 320, the masking particles are then removed, thereby resulting in the generation of the sub-micron structured surface 102, as shown in FIG. 3C.

Methods of generating and disposing masking sub-micron particles 302 are described throughout U.S. patent application Ser. No. 12/003,965, filed Jan. 3, 2008, the disclosure of which is incorporated by reference herein in its entirety. The term "masking sub-micron particles" as used herein encompasses masking crystals, masking wires, masking rods, masking ribbons, masking tetrapods, and other similar structures known to those skilled in the art. Masking sub-micron particles for use in the practice of the present invention suitably have at least one characteristic dimension less than about 1 μm, suitably less than about 750 nm, or less than about 500 nm. In exemplary embodiments, masking nanoparticles are utilized in the practice of the present invention. Masking nanoparticles of the present invention are suitably less than about 500 nm, less than about 300 nm, less than about 200 nm, less than about 100 nm, less than about 50 nm, less than about 20 nm, or less than abut 10 nm in size. As used herein "masking particles" includes both masking sub-micron particles and masking nanoparticles.

Masking particles for use in the present invention can be produced using any method known to those skilled in the art. Suitable methods are disclosed in U.S. Pat. Nos. 7,374,807 and 6,949,206, U.S. patent application Ser. No. 10/796,832, filed Mar. 10, 2004, U.S. Provisional Patent Application No. 60/578,236, filed Jun. 8, 2004, and U.S. patent application Ser. No. 11/506,769, filed Aug. 18, 2006, the disclosures of each of which are incorporated by reference herein in their entireties. The masking particles for use in the present invention can be produced from any suitable material, including an inorganic material, such as inorganic conductive materials (e.g., metals), semiconductive materials and insulator materials. Suitable semiconductor materials include those disclosed in U.S. patent application Ser. No. 10/796,832 and include any type of semiconductor, including group II-VI, group III-V, group IV-VI and group IV semiconductors. Suitable semiconductor materials include, but are not limited to, Si, Ge, Sn, Se, Te, B, C (including diamond), P, BN, BP, BAs, AlN, AlP, AlAs, AlSb, GaN, GaP, GaAs, GaSb, InN, InP, InAs, InSb, AlN, AlP, AlAs, AlSb, GaN, GaP, GaAs, GaSb, ZnO, ZnS, ZnSe, ZnTe, CdS, CdSe, CdTe, HgS, HgSe, HgTe, BeS, BeSe, BeTe, MgS, MgSe, GeS, GeSe, GeTe, SnS, SnSe, SnTe, PbO, PbS, PbSe, PbTe, CuF, CuCl, CuBr, CuI, $Si_3N_4$, $Ge_3N_4$, $Al_2O_3$, $(Al, Ga, In)_2 (S, Se, Te)_3$, $Al_2CO$, and an appropriate combination of two or more such semiconductors. Suitable metals include, but are not limited to, Group 10 atoms such as Pd, Pt or Ni, as well as other metals, including but not limited to, W, Ru, Ta, Co, mo, Ir, Re, Rh, Hf, Nb, Au, Ag, Fe, and Al. Suitable insulator materials include, but are not limited to, $SiO_2$, $TiO_2$ and $Si_3N_4$. In further embodiments, the masking particles for use in the practice of the present invention can be prepared from suitable polymers, for example, polystyrene, poly(methyl methacrylate), as well as other polymers known in the art.

The masking particles useful in the present invention can also further comprise ligands conjugated, associated, or otherwise attached to their surface. Suitable ligands include any group known to those skilled in the art, including those disclosed in (and methods of attachment disclosed in) U.S. Pat. Nos. 6,949,206 and 7,374,807, and U.S. Provisional Patent Application No. 60/578,236, the disclosures of each of which are hereby incorporated by reference herein for all purposes. Use of such ligands can enhance the ability of the masking particles to associate and spread on the various material surfaces that are being patterned, such that the material surface is substantially covered by masking particles in a uniform, ordered manner. In addition, such ligands act to keep the individual masking particles separate from each other so that they do not aggregate together prior to or during application.

Masking particles can be disposed onto a substrate using any suitable method, including, for example, spin-coating, spray-coating, layering, spreading, depositing and other forms of disposing onto the substrate. The masking particles cover at least a portion of a substrate onto which they have been disposed. Suitably, the masking particles are substantially uniform in size and substantially uniformly spaced on the substrate. Suitably, the masking particles are homogenously distributed across the surface of the substrate, though in additional embodiments, the masking particles can be selectively or specifically disposed in a particular area(s) of the substrate, or the distribution can be random across the surface of the substrate.

Suitably, uncovered substrate is removed in step 326 by etching substrate 304. However, since the portions of substrate 304 that are covered by masking particles 302 are protected from etching, only the unprotected portions of substrate 304 are removed. Therefore, as substrate 304 is selectively etched, sub-micron scale structures 306 are formed "below" the masking particles (e.g., FIG. 3B). It should be understood that the term "below" represents one embodiment of the present invention in which the spatial orientation of substrate 304 and masking particles 302 is as represented in FIGS. 3A-3C, and other spatial orientations are readily envisioned by one of ordinary skill in the art and therefore fall within the scope of the present invention. It should also be understood that the number and orientation/spacing of masking particles 302 in FIGS. 3A-3C is provided only for illustrative purposes. In exemplary embodiments, masking particles 302 are disposed in closer proximity and over a wider range on substrate 304 than is illustrate in FIGS. 3A-3C.

As used herein, the terms "etch" or "etching" refer to any process, including chemical, physical, or energetic, which removes exposed or uncovered material of a substrate. Examples of suitable etching methods include, but are not limited to, chemical etching, such as acid or base etching, including wet chemical etches (e.g., using Acetic Acid ($H_3COOH$), Hydrochloric Acid (HCl), Hydrofluoric Acid (HF), Nitric Acid ($HNO_3$), Phosphoric Acid ($H_3PO_4$), Potassium Hydroxide (KOH), Sodium Hydroxide (NaOH), Sulfuric Acid ($H_2SO_4$), as well as other chemicals known by one of ordinary skill in the art, see e.g., U.S. Pat. Nos. 7,153,782, 7,115,526, 5,820,689); photochemical etching, see e.g., U.S. Pat. Nos. 4,414,066 and 5,092,957, as well as Ashby, "Photochemical Dry Etching of GaAs", *Appl. Phys. Lett.* 45:892 (1984); Ashby et al., "Composition-selective Photochemical Etching of Compound Semiconductors", *Appl. Phys. Lett.* 47:62 (1985), Smith, R. A., Semiconductors, 2nd Ed., Cambridge Univ. Press, New York, 1978, p. 279; plasma etching, see e.g., U.S. Pat. Nos. 3,615,956, 4,057,460, 4,464,223 and 4,595,454; reactive ion etching (RIE), see e.g., U.S. Pat. Nos. 3,994,793, 4,523,976 and 4,599,136; electron beam etching, see e.g., U.S. Pat. Nos. 4,639,301, 5,149,974 and 6,753,538, and also, Matsui et al., "Electron Beam Induced Selective Etching and Deposition Technology," *Journal of Vacuum Science and Technology B* 7 (1989), Winkler et al. "E-Beam Probe Station With Integrated Tool For Electron Beam Induced Etching," *Microelectronic Engineering* 31:141-147 (1996). Each of the patents and references listed above are hereby incorporated by reference herein in their entireties for all purposes, specifically for their disclosure of various etching methods and compositions.

In exemplary embodiments, uncovered portions of substrate 304 are removed by etching anisotropically. As used herein, etching anisotropically means that the rate of etching in one primary direction is greater than the rate of etching in other directions. Suitably, in anisotropic etching, the rate of etching is nearly zero in directions other than the primary direction (for example, normal to the plane of the substrate surface). In further embodiments, the etching of substrate 304 can occur isotropically. Isotropic etching refers to an etching process in which the rate of etching is the same, or substantially the same, in all directions. That is, there is no primary direction of etching. For use in the practice of the present invention, while either anisotropic or isotropic etching can be used, anisotropic etching provides a method for controlling the amount, orientation and type of substrate that is being etched.

For example, as shown in FIG. 3B, the use of an anisotropic etch (e.g., RIE or electron beam etching) allows for substrate 304 that is not covered by masking particles to be etched away, but only in a direction that is normal to the plane of the substrate, thereby forming sub-micron structures 306 below the masking particles 302. As the substrate is etched away anisotropically, i.e., only in a direction normal to the plane of the substrate, the cross-sectional diameter of the sub-micron structures 306 that are generated are substantially the same size as the masking particles that covered the substrate 304. For example, if masking particles with a diameter of about 500 nm are disposed on a substrate and an anisotropic etched is performed on uncovered portions of the substrate such that the etching proceeds to a depth of about 500 nm, nanostructures with dimensions on the order of about 500×500 nm are generated. In further embodiments, the anisotropic etch can be performed for a longer or shorter time, so that structures are formed that have one dimension longer than the other. For example, sub-micron structures with a cross-sectional diameter equal to about the diameter of the masking particles, but an extended length dimension can be generated.

Any suitable method can be used to remove masking particles, for example, simply washing or rinsing substrate 304 with a solution (e.g., alcohol or aqueous solution) to remove the masking particles. In other embodiments, the masking particles can be selectively etched away using the various methods known in the art and discussed throughout, or they can be melted away, or simply physically removed.

In exemplary embodiments, substrate 304 is a metal substrate, including the various metals described herein, for example, a nickel substrate. In further embodiments, a polymeric or ceramic substrate 304 can be utilized.

Generation of sub-micron structures 306 in substrate 304 also results in the formation of a plurality of indentations 308, where uncovered substrate material was selectively removed during step 326. As noted herein, suitably indentations 308 in substrate 304 have at least one lateral dimension that is less than about 500 nm. Thus, while the size of masking particles 302 determines that dimensions of sub-micron structures 306, the spacing between masking particles 302 when they are disposed on the surface of substrate 304 impacts the lateral dimensions of indentations 308, and thus the final structure of the sub-micron structured surface 102.

The present invention also provides liquidphobic surfaces generated by the various methods described herein, including the use of sub-micron-structured surfaces such as sub-micron wires or nanowires, as well as masking particles, to generate a sub-micron-structured surface 102 on the first substrate. Suitably, the liquidphobic surfaces of the present invention comprise at least one sub-micron-structure has at least one lateral dimension less than about 500 nm, and a liquidphobic coating comprising a perfluorinated organic coating. Suitably, the liquidphobic surface is super-liquidphobic.

Figure 4A:
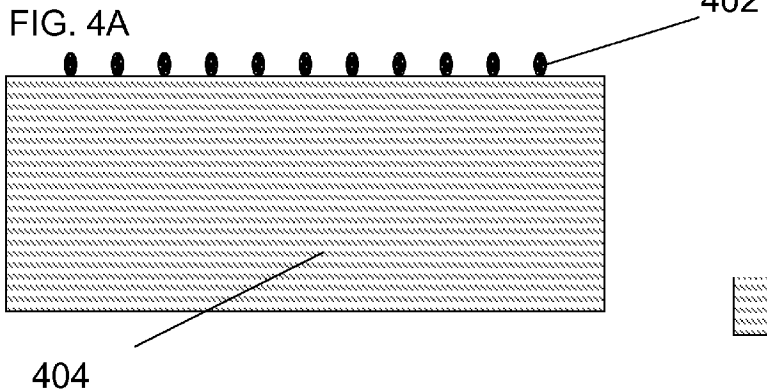
FIGS. 4A-4D show a further method of generating a liquidphobic surface in accordance with one embodiment of the present invention.
Figure 4B:
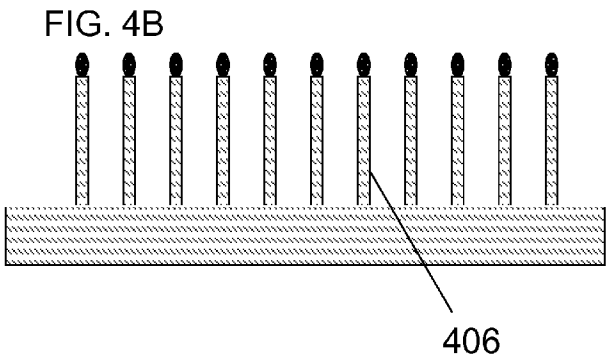
Figure 4C:
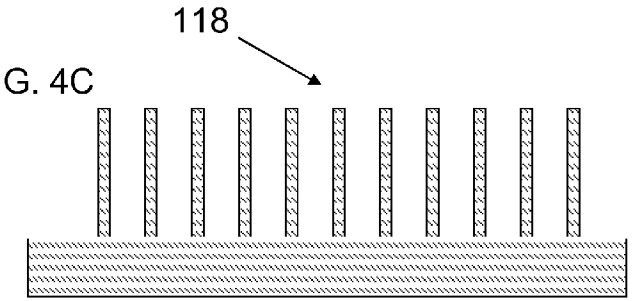
Figure 4D:
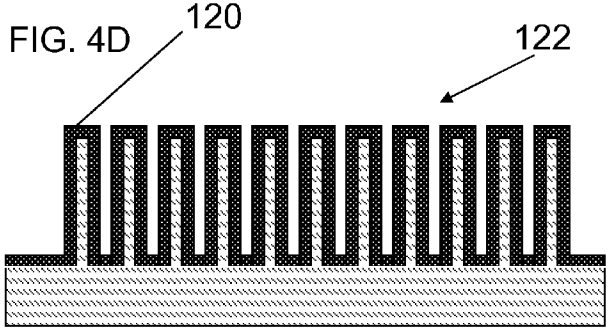
Figure 4E:
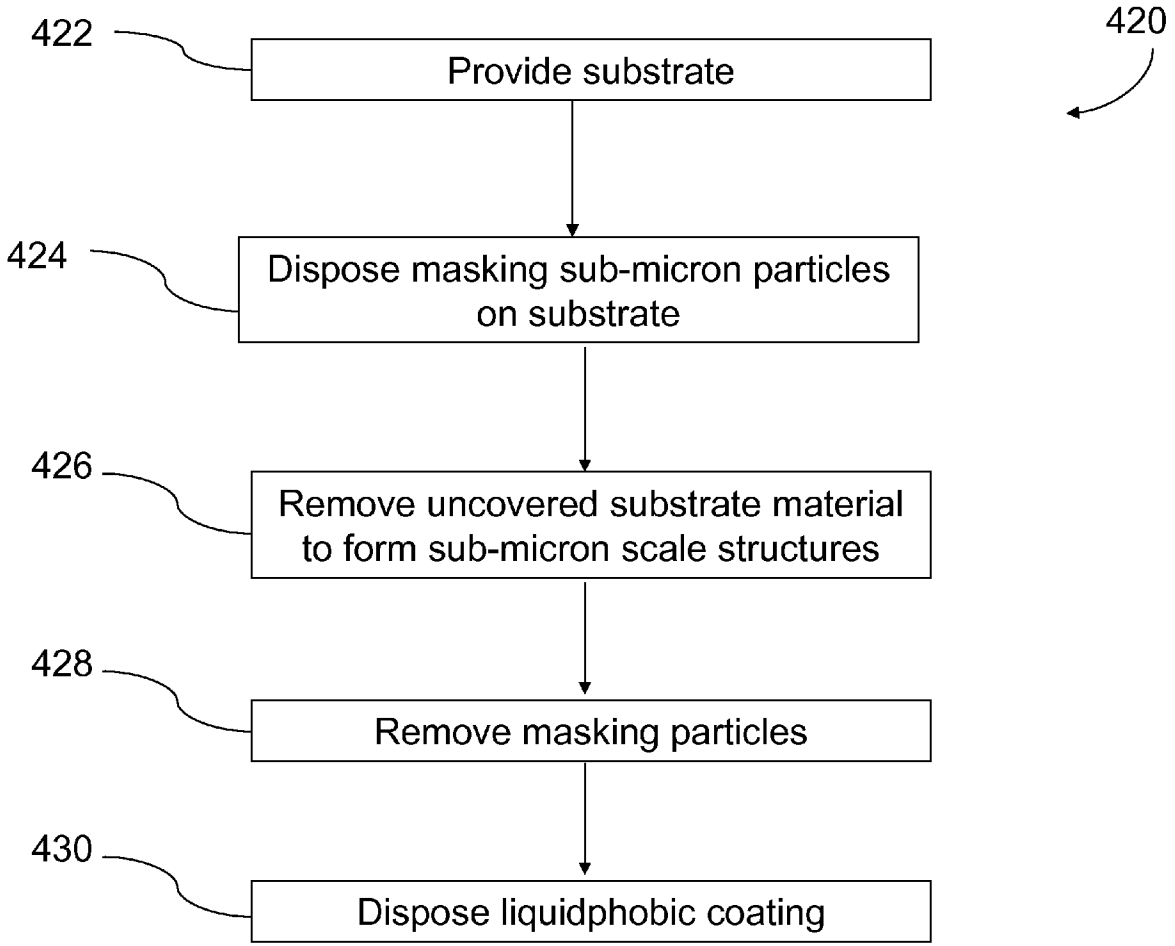
FIG. 4E shows a flowchart of a further method of generating a liquidphobic surface in accordance with one embodiment of the present invention.

In further embodiments, the present invention provides additional methods of generating a liquidphobic surface 122, as shown in flowchart 420 of FIG. 4E with reference to the schematics of FIGS. 4A-4D. In step 422 of flowchart 420, a substrate 404 is provided. One or more masking sub-micron particles 402 are then disposed on substrate 404 in step 424. Suitably, the particles 402 cover at least a portion of the substrate 404. In step 426, uncovered substrate material is then removed. As shown in FIG. 4B, this forms substrate sub-micron-scale structures 406 at the site of the masking particles 402. In step 428 of flowchart 420 of FIG. 4D, the masking particles 402 are removed, thereby forming the sub-micron structured surface 118 of FIG. 4C. Then, in step 430, a liquidphobic coating 120 is disposed on the surface 118 so as to generate a liquidphobic surface 122.

Suitably, substrate 404 from which the sub-micron-structured surface is formed is a glass, a plastic, a ceramic, a metal, etc. In exemplary embodiments, the substrate comprises a glass, such as $SiO_2$. As described throughout, the sub-micron-scale structures 406 that are formed in substrate 404 have at least one lateral dimension less than about 1 μm, suitably less than about 750 nm, less than about 500 nm, less than about 250 nm, or less than about 100 nm. The liquidphobic coating that is disposed on the sub-micron-structure is suitably a perfluorinated organic coating, though other coatings as described herein can also be used.

Methods for disposing masking sub-micron particles, as well as exemplary sizes and compositions of masking particles for use in the practice of the present invention are described herein, and in U.S. patent application Ser. No. 12/003,965. In suitable embodiments, the masking sub-micron particles are masking nanoparticles, for example, metallic or semiconductor nanoparticles. Methods for removing uncovered substrate material are also described herein and in U.S. patent application Ser. No. 12/003,965, and suitably include various etching methods, suitably anisotropic etching, whereby material is removed in a direction that is substantially into the plane of substrate 404, thereby forming sub-micron structures 406 that are uniformly sized and spaced.

The present invention also provides liquidphobic surfaces 120 that are generated by the processes of the present invention, such as shown in FIG. 4D. As noted herein, suitably the substrate 402 onto which a liquidphobic surface 122 is produced is a metal, a polymer, a glass, a ceramic, etc. Suitably, the substrate 402 comprises a glass, such as a glass comprising $SiO_2$. As noted, herein, suitably the liquidphobic coating that is disposed on the sub-micron structured surface comprises a perfluorinated organic coating, though other coatings as described herein can also be used. In exemplary embodiments, the liquidphobic surface 122 of the present invention is super-liquidphobic.

The present invention also provides various articles comprising liquidphobic surfaces that have been generated using the various methods described herein. For example, the liquidphobic surfaces can be utilized in reflective surfaces, such as, reflective films, reflective tapes, reflective fabrics and marker dots, as well as reflective objects, such as reflective spheres, which can be used in biomedical applications. In further embodiments, the liquidphobic surfaces can be generated on the surface of a transparent, semi-transparent, or translucent substrate, such as a glass or a plastic. Suitably, the liquidphobic surfaces can be generated on the surface of a lens or transparent (or semi-transparent) surface of glasses or goggles, a windshield or window, etc. The liquidphobic surfaces help to prevent or limit fouling, including the accumulation of soluble dirt or other liquids on the surfaces, thus enhancing the ability to see through the surfaces (e.g., in the case of goggles or glasses) or the ability project light through the surfaces (e.g., in the case of lenses).

It will be readily apparent to one of ordinary skill in the relevant arts that other suitable modifications and adaptations to the methods and applications described herein can be made without departing from the scope of the invention or any embodiment thereof.

Exemplary embodiments of the present invention have been presented. The invention is not limited to these examples. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the invention.

All publications, patents and patent applications mentioned in this specification are herein incorporated by reference to the same extent as if each individual publication, patent or patent application was specifically and individually indicated to be incorporated by reference.

What is claimed is:

1. A method of generating a liquidphobic surface, comprising:

(a) providing a first substrate;

(b) providing a sub-micron-structured surface on the first substrate by growing upstanding sub-micron nanowires on the substrate which extend perpendicular to the substrate, the nanowires having an aspect ratio (length: width) of 2 or greater;

(c) transferring a sub-micron-structure complementary to the sub-micron-structured surface to a surface of a second substrate; and (d) disposing a liquidphobic coating on the surface of the second substrate;

wherein the transferring in (c) comprises evaporating and/or plating metal onto the sub-micron-structured surface of the first substrate, resulting in a complementary sub-micron-structure in the metal.

2. The method of claim 1, wherein the providing comprises providing a first substrate comprising a metal.

3. The method of claim 2, wherein the providing comprises providing a nickel substrate.

4. The method of claim 1, wherein the disposing comprises disposing a perfluorinated organic coating.

5. A method of generating a liquidphobic surface, comprising:

(a) generating a sub-micron-structured surface on a first substrate by growing sub-micron upstanding nanowires on the substrate which extend perpendicular to the substrate, the nanowires having an aspect ratio (length: width) of 2 or greater;

(b) transferring a sub-micron-structure complementary to the sub-micron-structured surface to a surface of a second substrate; and (c) disposing a liquidphobic coating on the surface of the second substrate;

wherein the transferring in (b) comprises evaporating and/or plating metal onto the sub-micron-structured surface of the first substrate, resulting in a complementary sub-micron-structure in the metal.

6. The method of claim 5, wherein the generating in (a) comprises:

i. providing a substrate;

ii. generating a sub-micron-structured surface on the surface of the substrate to generate a transfer substrate; and iii. transferring a sub-micron-structure complementary to the sub-micron-structured surface of the transfer substrate to a surface of the first substrate.

7. The method of claim 6, wherein the providing comprises providing a silicon substrate.

8. The method of claim 5, wherein nickel is evaporated and then plated onto the sub-micron-structured surface of the first substrate.

* * * * *